United States Patent [19]

Zinnbauer

[11] Patent Number: 4,771,923

[45] Date of Patent: Sep. 20, 1988

[54] TAMPER EVIDENCING CAP

[75] Inventor: Gerald Zinnbauer, Charlotte, N.C.

[73] Assignee: Kardon Industries, Inc., Philadelphia, Pa.

[21] Appl. No.: 116,026

[22] Filed: Nov. 3, 1987

[51] Int. Cl.[4] ..... A67B 5/00; B65D 47/10

[52] U.S. Cl. ..... 222/153; 222/519; 222/532; 222/541; 220/266; 215/253

[58] Field of Search ..... 222/519, 531, 532, 541, 222/153, 562; 220/266; 215/253, 258

[56] References Cited

U.S. PATENT DOCUMENTS

| | | | |
|---|---|---|---|
| 1,875,431 | 9/1932 | Fabrice . | |
| 2,028,175 | 1/1936 | Waite | 221/60 |
| 2,201,205 | 5/1940 | Samburg | 215/7 |
| 2,334,851 | 11/1943 | Waite | 221/60 |
| 2,346,181 | 4/1944 | Overend | 222/519 |
| 2,414,420 | 1/1947 | Sebell | 215/43 |
| 2,582,566 | 1/1952 | Schwimmer et al. | 222/519 X |
| 2,805,800 | 9/1957 | Malick | 222/519 |
| 3,151,777 | 10/1964 | Rooney | 222/92 |
| 3,241,731 | 3/1966 | Bright et al. | 222/541 |
| 3,254,807 | 6/1966 | Boch et al. | 222/541 X |
| 3,261,513 | 7/1966 | Moran | 222/519 |
| 3,317,093 | 5/1967 | Moran | 222/519 X |
| 3,335,889 | 8/1967 | Brumme | 215/7 |
| 3,463,341 | 8/1969 | Feilds | 222/541 X |
| 3,673,761 | 7/1972 | Leitz | 53/42 |
| 3,957,169 | 5/1976 | Coursaut | 215/253 |
| 4,122,965 | 10/1978 | Roy | 215/344 |
| 4,295,584 | 10/1981 | Borowitz | 222/519 |
| 4,303,168 | 12/1981 | Roy | 215/344 |
| 4,434,904 | 3/1984 | D'Amico et al. | 215/253 X |
| 4,444,328 | 4/1984 | Glass | 215/230 |
| 4,448,317 | 5/1984 | Thompson | 215/203 |
| 4,480,761 | 11/1984 | Aichinger | 215/252 |
| 4,501,373 | 2/1985 | Heinlein | 215/253 X |
| 4,506,795 | 3/1985 | Herr | 215/252 |
| 4,549,667 | 10/1985 | Dullabaun | 215/253 X |
| 4,573,601 | 3/1986 | Berglund | 215/252 |
| 4,591,062 | 5/1986 | Sandhaus | 215/230 |
| 4,595,110 | 6/1986 | Herr | 215/252 |
| 4,595,547 | 6/1986 | Herr | 264/154 |
| 4,598,833 | 7/1986 | Herr | 215/220 |
| 4,667,853 | 5/1987 | Kruger | 222/541 X |

FOREIGN PATENT DOCUMENTS

| | | | |
|---|---|---|---|
| 1268937 | 6/1961 | France . | |
| 3514132 | 10/1986 | Fed. Rep. of Germany | 222/519 |
| 527065 | 5/1955 | Italy . | |
| 974564 | 11/1964 | United Kingdom . | |

*Primary Examiner*—F. J. Bartuska
*Assistant Examiner*—Gregory L. Huson
*Attorney, Agent, or Firm*—Benasutti & Murray

[57] ABSTRACT

A tamper evidencing closure for a container, such as a bottle, in which a tamper indicator is completely separated from the closure upon removal of the closure. The tamper indicator is separated from the closure as the closure is removed from the container by contact between the tamper indicator and a finish on the container. The tamper indicator may form a product outlet in the closure when it is separated from the closure.

27 Claims, 4 Drawing Sheets

FIG. 1
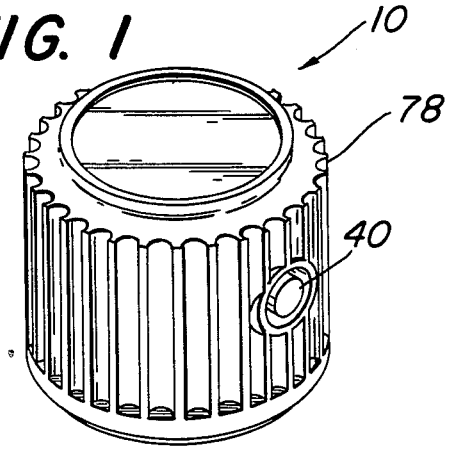
FIG. 2
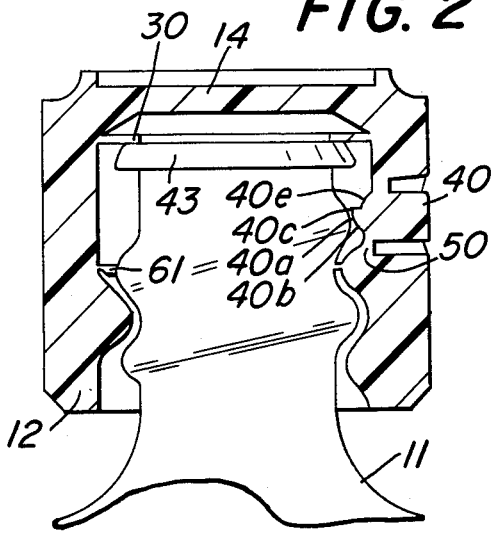
FIG. 3
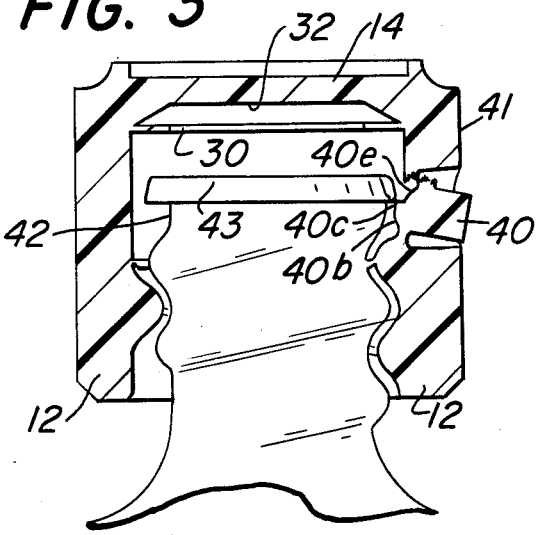
FIG. 4A
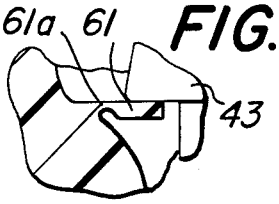
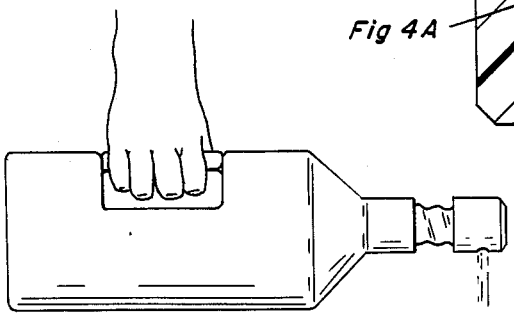
FIG. 5
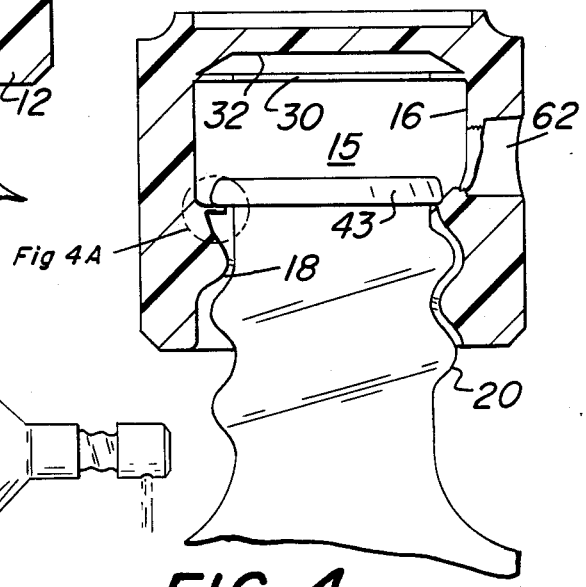
FIG. 4

FIG. 16
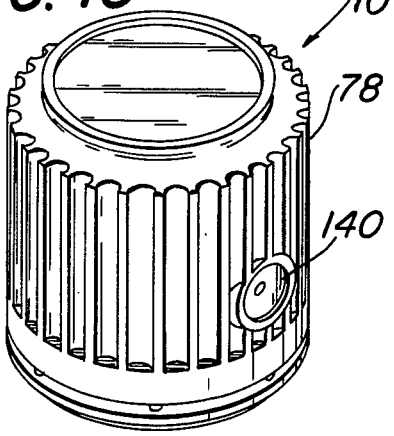
FIG. 17
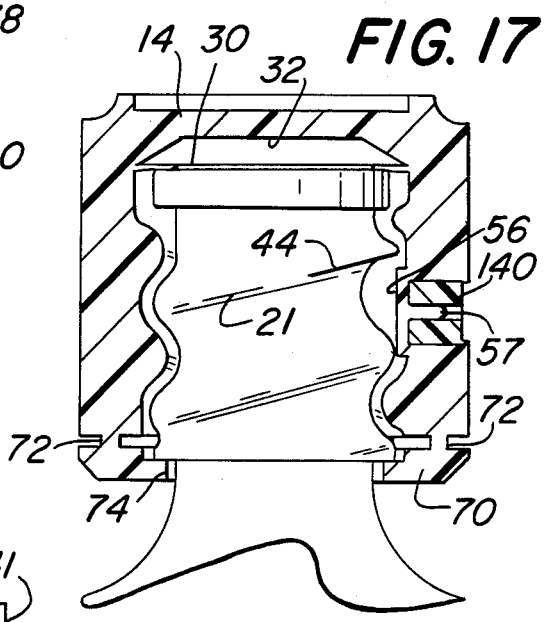
FIG. 18
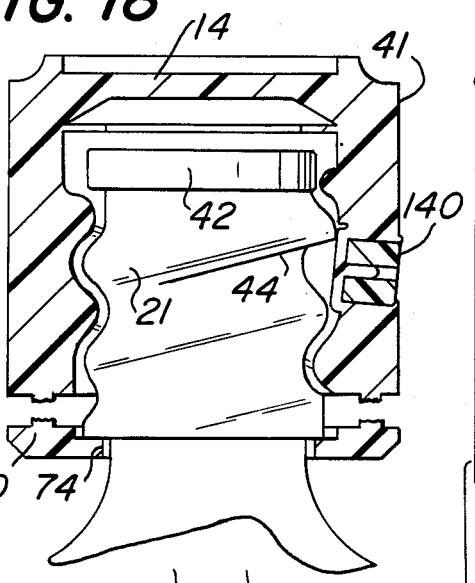
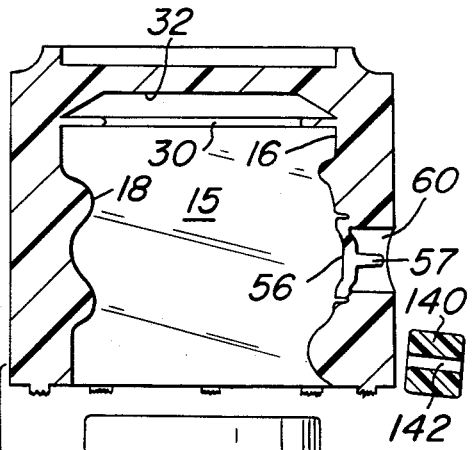
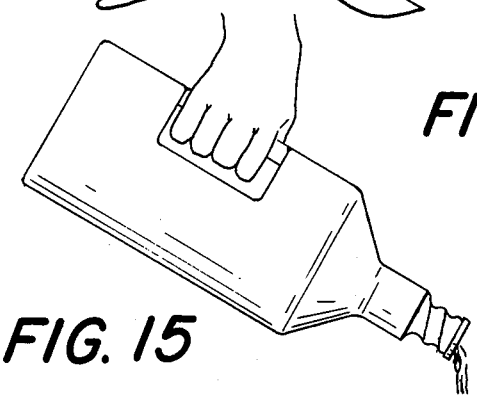
FIG. 15
FIG. 19
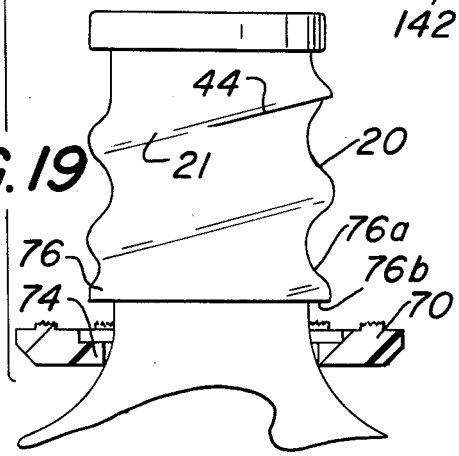

TAMPER EVIDENCING CAP

BACKGROUND OF THE INVENTION

This invention relates to tampering evidencing caps for containers, such as bottles, which provide visual evidence of previous cap removal. More particularly, the present invention relates to a tamper evidencing cap in which an indicator is automatically separated from the cap upon cap removal.

A variety of apparatus have been developed to indicate tampering with containers, especially containers for holding food and medicine. These apparatus allow the consumer to visually determine if a container has been tampered with prior to use. For example, the following U.S. patents include tamper indicating means comprising a cap which separates from a ring when the cap is removed from a bottle neck, U.S. Pat. Nos.: 3,673,761; 4,480,761; 4,506,795; 4,595,110; 4,595,547; 4,598,833; 4,591,062; 3,957,169; 1,875,431; 3,335,889; 4,573,601; UK Pat. No. 974,564; Italian Pat. No. 527065; and French Pat. No. 1,268,937.

Other known tamper evidencing means includes a label or indicator oriented on a bottle cap which is deformed or destroyed upon removal of the cap from the bottle. See for examples U.S. Pat. Nos.: 4,444,328; 2,201,205; 2,414,420; and 4,448,317.

SUMMARY OF THE INVENTION

It is accordingly an object of the present invention to provide an novel tamper evidencing cap for a container.

It is another object of the present invention to provide a tamper evidencing cap which provides a visual indication of tampering.

It is still another object of the present invention to provide a tamper evidencing cap which is capable of employing a visual tamper indicator in a variety of shapes.

It is yet another object of the present invention to provide a visual tamper indicator which is automatically separated from the cap upon removal of the cap from the container.

It is yet another object of the present invention to provide a visual tamper indicator which can include a proprietary shape or indicator which separates from the cap as the cap is unthreaded from the container.

It is yet another object of the present invention to provide a visual tamper indicator which separates from the cap upon unthreading to form a discharge opening for the container contents.

The present invention provides a tamper evidencing container closure in which a plug or other removable member is automatically separated from the container cap upon unthreading of the cap from the container. The cap preferably includes an integral sealing means oriented on the interior surface of the top of the cap which provides for resealing of the container when the cap is threaded on the container. The flexible sealing means contacts the container opening to reseal the container when the cap is screwed downwardly on the container.

The removable member or plug is separated from the container cap by contact of the removable member with a finish on the container neck as the cap is unscrewed. The contact between the removable member and the container finish automatically separates the member from the cap so that absence of the removable member indicates that the cap has been unscrewed.

The container cap may include an additional tamper evidencing means comprising a separable ring which is fitted to the container neck in such a manner that upon removal of the cap, the ring separates from the cap and remains oriented on the container neck.

Additionally, the cap may include a stop located on a section of the threads of the cap to contact a finish on the container neck to prevent complete removal of the cap from the container. A discharge opening for the contents of the container is formed by separation of the removable member from the cap during unthreading of the cap. The side discharge opening is easily closed by threading the cap back onto the container so that the seal means on the interior surface on the top of the cap seals the container opening. The removable member thus serves as both a tamper evidencing means as well as forming a discharge opening for the container contents upon opening. The stop means of the cap prevents the cap from becoming physically separated from the container.

All of the features and advantages will be apparent from the following detailed description of the preferred embodiments and from the claims. For a full understanding of the present invention, reference should now be made to the following descriptions and to the accompanying drawings.

BRIEF DESCRIPTION OF THE DRAWINGS

FIG. 1 is a perspective view of a tamper evidencing container closure in accordance with the present invention.

FIG. 2 is a cross-sectional side view of the container closure of FIG. 1 oriented in a seated position on a container.

FIG. 3 is a cross-sectional side view of the container closure of FIG. 1 oriented in a partially unseated position on a container.

FIG. 4 is a cross-sectional side view of the container closure of FIG. 1 oriented in a fully opened position on a container.

FIG. 4A is an enlargement of a section of FIG. 4.

FIG. 5 is a perspective view of a container including the container closure of FIG. 4 opened and pouring a liquid.

FIG. 15 is a perspective view of the container of FIG. 14 pouring a liquid.

FIG. 16 is a perspective view of an alternate embodiment of the container closure of the present invention.

FIG. 17 is a cross-sectional side view of the container closure of FIG. 16 oriented on a container in a seated position.

FIG. 18 is a cross-sectional side view of the container closure of FIG. 16 oriented on a container in a partially seated position.

FIG. 19 is a cross-sectional side view of the container closure of FIG. 16 in an unseated position.

DETAILED DESCRIPTION OF THE PREFERRED EMBODIMENT

Figure 6:
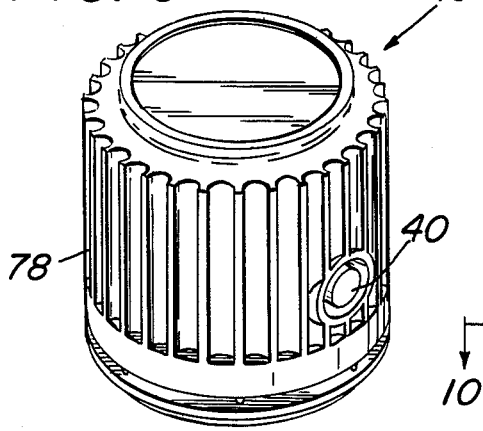
FIG. 6 is a perspective view of alternate embodiment of the container closure of the present invention.
Figure 7:
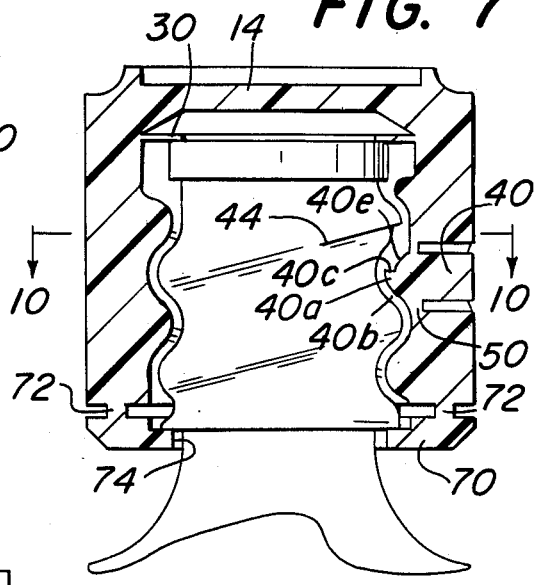
FIG. 7 is a cross-sectional side view of the container closure of FIG. 6 oriented in a seated position on a container.
Figure 8:
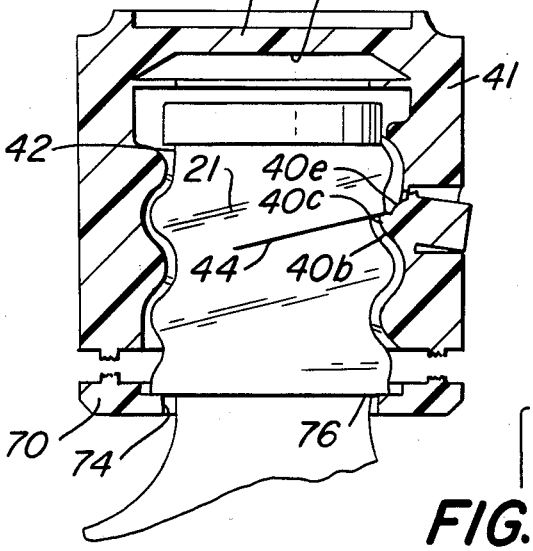
FIG. 8 is a cross-sectional side view of the container closure of FIG. 6 oriented in a partially unseated position on a container.
Figure 8:
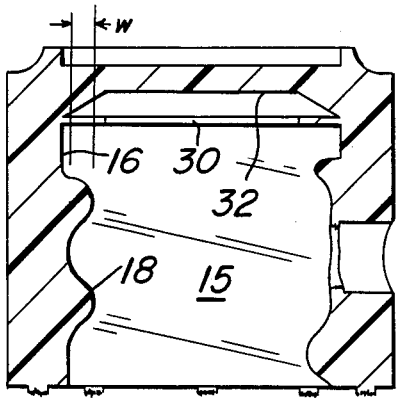
Figure 9:
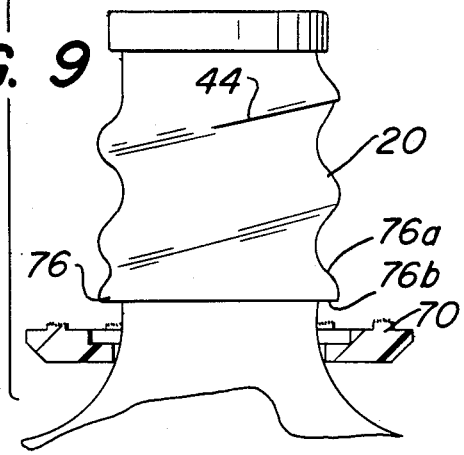
FIG. 9 is a cross-sectional side view of the container closure of FIG. 6 removed from the container.

The present invention is generally related to a tamper evidencing cap 10 for a bottle or container having an externally threaded neck. The cap 10 includes a hollow, substantially tubular interior 15 with an opening at the bottom 12 and a closed top 14. The interior sidewall 16, of cap 10 includes threads 18. Cap threads 18 mate with threads 20 on the container neck 11 to resealably fix the cap 10 to the container neck 11. Those skilled in the art will recognize that the neck shape and thread configuration is generally referred to as the finish. In this disclosure, bottle finish will mean those surface features on the bottle in addition to a normal thread configuration.

The top 14 of cap 10 has a flexible sealing means 30 depending inwardly from the interior surface 32 of top 14. Flexible sealing means 30 can be formed integrally with cap 10, as shown, or may comprise a separate element adapted to be oriented in cap 10. Sealing means 30 is generally liquid tight and depends inwardly from interior surface 32 of cap 10 so as to contact the top of container neck 11. Contact of flexible sealing means 30 with the top of container neck 11 seals the container opening when the cap 10 is threaded onto the container neck 11.

A tamper evidencing means 40 or 140 is oriented on an exterior lateral or vertical surface 41 of cap 10. The tamper indicator 40 or 140 is positioned to be completely separated from cap 10 when cap 10 is unscrewed from container neck 11. Adjacent the threaded portion 20 of container neck 11, at the container opening is cooperating container finish 42. Container finish 42 can comprise a separate ring 43, extending outwardly around the container opening, FIGS. 1 through 4, or finish 42 may comprise an extension 44 of a thread 21 of container neck 11, FIGS. 6 through 9. The finish 42 is oriented so that it contacts the interior surface **40*a* of tamper indicator 40 as cap 10 is unscrewed and cooperates therewith to dislodge indicator 40** from the cap.

Tamper indicator 40 includes a interior surface **40*a* which extends into the interior 15 of cap 10. Interior surface 40*a* extends into cap 10 a sufficient distance so as to contact finish 42 as cap 10 is removed from the container neck 11 as by unthreading. Surface 40*a* includes a curved first edge 40*b* which generally complements the shape of threads 18. Edge 40*b* is shaped complementary to threads 18 to allow cap 10 to be threaded onto container neck 11 without separating tamper indicator 40 from cap 10. Sloping curved edge 40*b* terminates in a lip 40*c* having a flat top surface. Upper sloping curved edge 40*e* extends from top surface of lip 40*c* to the cap interior sidewall 16. Lip 40*c* and upper curved edge 40*e* extends into the interior 15 of cap 10 a sufficient distance so as to contact finish 42 as cap 10 is unscrewed. The motion of unscrewing cap 10 causes contact of upper curved edge 40*e* and lip 40*c* with finish 42 as the cap 10 is unscrewed and creates a force which deforms and breaks the supporting means for tamper indicator 40**, as described below.

Figure 10:
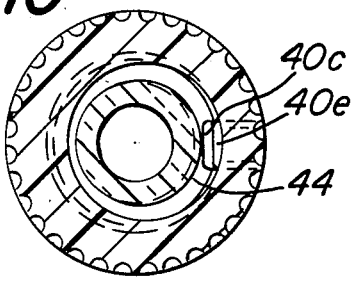
FIG. 10 is a cross-sectional view along line 10—10 of FIG. 7.
Figure 11:
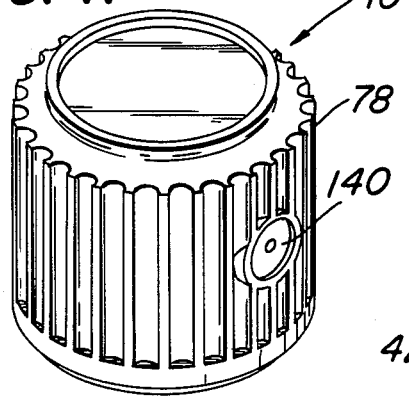
FIG. 11 is a perspective view of an alternate embodiment of the container closure of the present invention.
Figure 12:
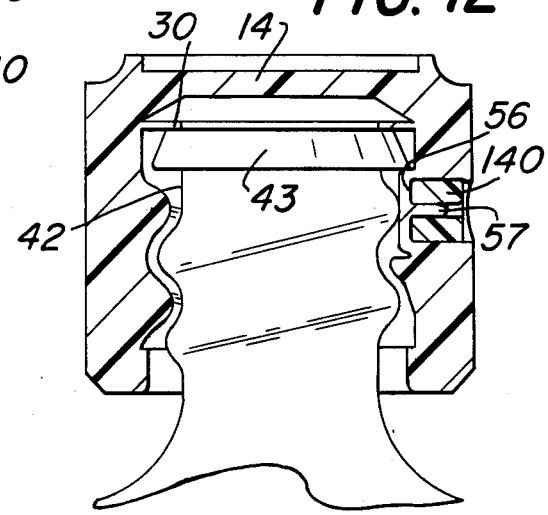
FIG. 12 is a cross-sectional side view of the container closure of FIG. 11 oriented in a seated position on a container.
Figure 13:
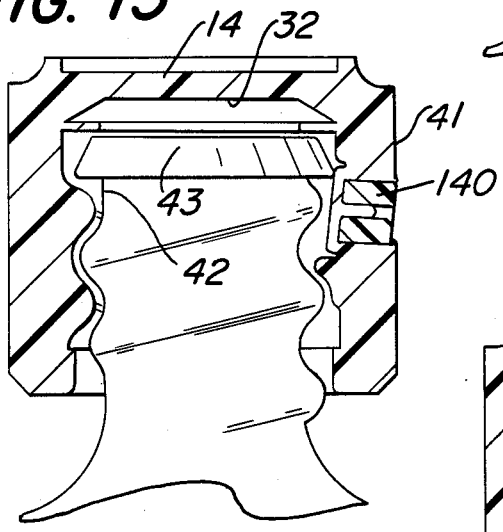
FIG. 13 is a cross-sectional side view of the container closure of FIG. 11 oriented in a partially unseated position on a container.
Figure 14:
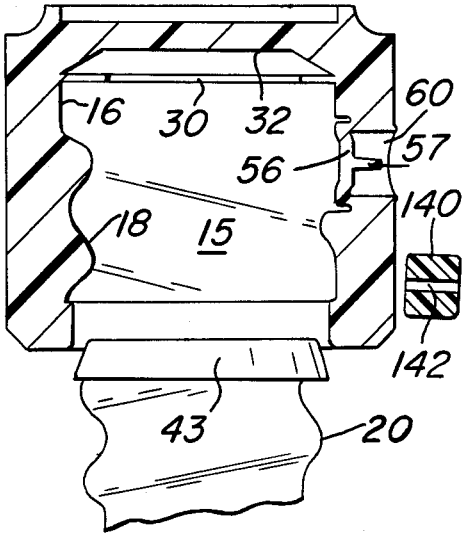
FIG. 14 is a cross-sectional side view of the container closure of FIG. 11 in an unseated position.

The extension of upper curved edge **40*e* and lip 40*c* into the interior 15 of cap 10 results in a contact between upper curved edge 40*e* and lip 40*c* and finish 42 as cap 10 is removed from the bottle. This contact is provided by forming upper curved edge 40*e* and lip 40*c* such that a portion of upper curved edge 40*e* and lip 40*c* extend into interior 15 a distance slightly greater than the width W of threads 18. See FIGS. 9 and 10. As the cap is unthreaded, upper curved edge 40*e* and lip 40*c* contact finish 42, either tapered surface 43, FIGS. 2–4, or extension 44 of thread 21, FIGS. 7–9. As upper curved edge 40*e* and lip 40*c* moves along surface 43 or extension 44, in a sliding fashion, the vertical motion of unthreading cap 10 in combination with the contact between upper curved surface 40*e* and lip 40*c* and surface 43 or extension 44 provides the force necessary to separate tamper indicator 40 from cap 10, FIGS. 3 and 8**.

Tamper indicator 40 is releasably supported on exterior lateral or vertical surface 41 of cap 10. The means which supports tamper indicator 40 allows complete separation of tamper indicator 40 from cap 10. The support means may be formed by molding cap 10 and tamper indicator 40 as an intregral unit, FIGS. 1 through 9, with tamper indicator 40 supported by a reduced thickness section 50. Reduced thickness section 50 provides a frangible area adapted to be easily fractured, see FIGS. 3 and 8, as the cap 10 is unscrewed from container neck 11. Fracture of reduced thickness section 50 completely separates tamper indicator 40 from cap 10.

Alternatively, a separate tamper element 140, may be supported in a chamber 60 formed in lateral surface 41 of cap 10, FIGS. 11 through 19. In this embodiment, tamper element 140 is a plug, sized so as to frictionally fit within chamber 60. The tamper element 140 may be cylindrical, as shown, or any other appropriate shape. The chamber 60 includes a flexible bottom surface 56 adapted to contact container finish 42 as cap 10 is unscrewed, FIG. 12. Deformation of flexible bottom surface 56 through contact with finish 42 forces tamper element 140 from chamber 60, FIG. 12. Chamber 60 includes a finger or post 57 extending axially therein. Post 57 is provided to fit within opening 142 in tamper indicator 140. When tamper indicator 140 is forced from chamber 60, post 57 and flexible bottom surface 56 are deformed so as to prevent reinsertion of tamper indicator 140.

In either embodiment, the container finish contacts the releasing means for the tamper indicator 40 or element 140 which separates the tamper indicator 40 or element 140 from the cap 10 as the cap is unscrewed. This contact completely separates the tamper indicator 40 or element 140 from the cap 10. A purchaser is able to quickly and easily determine tampering by merely checking to see if the tamper indicator 40 or element 140 is present. While the tamper indicator 40 and element 140 are illustrated as being a disk or cylindrical in shape, other shapes can be easily employed. This allows a manufacturer to employ a specific logo or shape easily recognized by consumers as a tamper indicator 40 or element 140.

In the first embodiment shown in FIGS. 1 through 5, cap 10 includes a first seal and stop means 61 which extends inwardly from threads 18. Seal and stop means 61 is shaped so as to sealingly contact the bottle neck 11. Seal and stop means 61 is formed having sufficient resilience so as to provide a seal yet be rigid enough to act as a stop when it contacts finish 42. Seal and stop means 61 may include an undercut or reduce thickness section 61*a*, FIG. 4*a*, immediately adjacent cap interior surface 16. This undercut allow separation of cap 10 and seal 61 when cap 10 is completely removed from container 11.

The seal and stop means 61 is oriented on cap 10 between tamper indicator 40 and the bottom 12 of cap 10. Contact of seal and stop means 61 with container finish 42, FIGS. 4 and 4*a* prevents complete removal of cap 10 from the container. Contact of seal and stop means 61 with finish 42 also exposes opening 62 which acts as a side discharge opening for the container contents after tamper indicator 40 is dislodged, see FIG. 5. If cap 10 is completely removed from bottle 11 seal 61 seaprates from cap 10 and remains oriented around bottle 11.

When it is desired to provide a cap which is completely removable for pouring, see FIG. 15, seal and stop means 61 is omitted from cap 10, FIGS. 11 through 14. Cap 10 can be further modified with additional tamper evidencing means is desired in combination with tamper indicator 40 or element 140. Cap 10 can include a separable ring 70 releasably affixed to the bottom 12 of cap 10. Ring 70 is affixed to cap 10 by a series of frangible, upwardly extending posts 72. Ring 70 includes a lip 74 which extends inwardly into interior 15 of cap 10. Lip 74 contacts a second container finish 76 as cap 10 is unscrewed. The container finish 76 is oriented on container neck 11 below threads 20. The second finish 76 preferably has a sloping upper surface 76*a* and a bottom surface 76*b* substantially perpendicular to the container neck 11. This shapes allows lip 74 of ring 70 to be fitted over the second finish 76 during orientation of cap 10 on container neck 11.

In use, as cap 10 including ring 70, FIGS. 6–9 and 16–19 is unscrewed, tamper indicator 40 or element 140 is separated from cap 10 by contact with finish 42. Ring 70 contacts second finish 76 separating ring 70 from cap 10 by breaking frangible posts 72. Ring 70 thus remains oriented around container neck 11 and the broken posts 72 serve as additional indicators of cap removal.

The external surface 78 of cap 10 is shown as having a fluted design which is attractive and easily gripped for unthreading of cap 10. Other appropriate designs for the cap exterior will be recognized by persons skilled in the art.

The cap 10 of the present invention is preferably formed from a suitable plastic material such as polyethylene, polypropylene, polystyrene or polyvinylchloride. The material used is resilient enough to allow the cap to be oriented on the container without fracturing the frangible portions.

While the present invnetion has been described in terms of a number of preferred embodiments thereof, the invention is not limited thereto but rather comprends all modifications of and departures from those embodiments properly falling within the spirit and scope of the claims.

I claim:

1. A taper evidencing container cap comprising: a removeable member oriented in an opening on a lateral surface of a cap, supported by release means, said cap defining a tubular area having a closed and an open end, said removeable member having an interior surface which extends into said tubular area a distance sufficient so as to cause release of said removeable member from said opening through contact with a container exterior surface during removal of said cap from the container.

2. The container cap of claim 1 further including a seal oriented on an interior surface of said closed end.

3. The container cap of claim 1 further including a ring oriented at said open end of the cap supported by frangible means, said ring adapted to separate from the cap at said frangible means.

4. The container cap of claim 1 wherein said release means comprises a frangible supporting ring for said removable member which completely fractures as said removable member is released from said opening.

5. A container cap including a tamper evidencing means comprising;

a removable member oriented on a lateral surface of a container cap, said cap defining a tubular area having a closed end and an open end, said member supported within a chamber in said lateral surface, having a flexible base surface which extends into said tubular area a distance sufficient to contact a container exterior surface, said flexible base surface shaped so as to cause release of said removable member from said chamber when said base is flexed by contact with said container exterior surface during removal of said cap from a container.

6. The container cap of claim 5 further including a ring oriented at said open end of said cap supported by frangible means, said ring adapted to separate from said cap at said frangible means.

7. The container cap of claim 5 further including an interior flexible seal oriented on an interior surface of said closed end.

8. The container cap of claim 7 wherein said flexible seal is formed integrally with said cap.

9. A tamper evidencing closure for a container, comprising:

(a) a molded cap, which defines a tubular area having a closed end and an open end, having internal threads capable of mating with an externally threaded container opening; and (b) a removable tamper indicator releasably supported in an opening on a lateral surface of said cap, said tamper indicator including a surface extending into said tubular area a distance sufficient to contact an exterior finish of the container wherein said finish on the threaded container contacts said extending surface as said cap is unthreaded, to cause said indicator to be detected from said cap.

10. The tamper evidencing closure of claim 9 wherein said tamper indicator is supported by a frangible ring, said frangible ring fractured upon contact of said extending surface with said finish, whereby said indicator is detached from said cap.

11. The tamper evidencing closure of claim 9, further including a stop and seal means oriented on an interior surface of said cap adjacent said open end, said stop and seal means adapted to contact said finish on said threaded container to prevent complete removal of said cap from said container, whereby an opening created by detachment of said tamper indicator from said cap forms a outlet for contents of said container.

12. The tamper evidencing closure of claim 9, further including a ring capable of surrounding the outer periphery of said container opening, and a plurality of upwardly extending breakable posts that attach said ring to said cap.

13. The tamper evidencing closure of claim 9, wherein said cap further includes a seal oriented on an interior surface of said closed end of said cap to contact said container upon orientation of said cap on said container.

14. The tamper evidencing closure of claim 13, wherein said seal is a flexible seal formed intregrally with said cap.

15. A container cap which defines a tubular area having an open end and a closed end and having at least one interior thread to threadingly mate with a container neck, the cap having tamper evidencing means comprising:

(a) a removable member which extends into said tubular area a distance sufficient to contact a container finish on the neck of the container, releasably fixed in a cavity on a lateral surface of said cap, and said container finish on the neck of the container to contacting said removable member so as to cause said removable member to separate from said cap upon unthreading of said cap from the container.

16. The container cap of claim 15 wherein said removable member is supported by a frangible ring, said member including a rear surface which extends into said tubular area, to contact said finish of the container neck upon unthreading of the cap, thereby fracturing said frangible ring and separating said member from said cap.

17. The container cap of claim 15, wherein said removable member is said plug frictionally fitted in a cavity in said cap, said cavity having a flexible base portion which extends into said tubular area such that upon unthreading of said cap from said container, said finish of said bottle deforms said flexible base thereby forcing said plug from said cavity.

18. The bottle cap of claim 15 further including a ring, oriented at said open end of said cap, supported by frangible means, said ring extending to contact a container finish when said cap is threaded on said container whereby upon unthreading of said cap from said container, said ring separates from said cap at said frangible means.

19. The container cap of claim 15 further including a seal oriented on an interior surface of said closed end of said cap to contact said container upon orientation of said cap on said container.

20. The container cap of claim 19 wherein said seal is a flexible seal formed integrally with said cap.

21. A container closure including a dispensing opening, for a container having an exteriorly threaded neck comprising:

(a) a cap having a threaded interior surface which defines a tubular area having an open end and a closed end, to threadingly engage the container neck;

(b) a ring oriented on said interior surface, adapted to contact a finish on said container neck to prevent complete removal of said cap from said container neck;

(c) flexible first sealing means oriented on an interior surface of said closed end of said cap to sealingly contact said container neck when said cap is threaded onto the container; and (d) a removable member oriented in an opening on a lateral surface of said cap, supported by frangible means, having a surface extending into said tubular area a distance sufficient, to contact said finish to cause said support means to fracture and separate said member from said cap upon unthreading of said cap from said container thereby forming a discharge opening.

22. The container closure of claim 21, wherein said flexible sealing means is formed intregrally with said cap.

23. The container closure of claim 21, further including a second sealing means extending from said cap into said tubular area to contact said container neck when said cap is oriented on said container neck.

24. A tamper evidencing container cap comprising:

(a) a cap body having a generally tubular configuration which is closed at a first end and opened at a second end to define an open interior chamber which is dimensioned to complement a container exterior during closing thereof; and (b) a tamper evidencing member, releasably oriented in a chamber on a lateral surface of said cap body between the ends thereof, having an interior surface which extends into the interior chamber a distance sufficient to cause interference with the container exterior and release said member during opening of said container.

25. The container cap of claim 24 further including a seal oriented on an interior surface of said closed end.

26. The container cap of claim 24 further including a ring oriented at said opened end supported by frangible means, said ring adapted to separate from said cap at said frangible means during of opening of said container.

27. A container cap which defines a tubular area having an open end and a closed end and having at least one interior thread to threadingly mate with a container neck finish, the cap having a tamper evidencing means comprising:

(a) a removable plug member frictionaly fixed in a cavity on a lateral surface of said cap, said cavity having a flexible base portion which extends into said tubular area a distance sufficient to contact the container neck finish such that upon unthreading of said cap from said container, said finish of said container deforms said flexible base forcing said removable plug member from said cavity.

* * * * *